US006618963B2

(12) United States Patent
Theurer et al.

(10) Patent No.: US 6,618,963 B2
(45) Date of Patent: Sep. 16, 2003

(54) TRACK MAINTENANCE MACHINE AND METHOD FOR MONITORING A TRACK POSITION

(75) Inventors: Josef Theurer, Vienna (AT); Herbert Wörgötter, Gallneukirchen (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 10/172,048

(22) Filed: Jun. 14, 2002

(65) Prior Publication Data

US 2002/0194751 A1 Dec. 26, 2002

(30) Foreign Application Priority Data

Jun. 21, 2001 (AT) ..... 488/2001

(51) Int. Cl.[7] ..... E01B 35/00; G01C 7/04
(52) U.S. Cl. ..... 37/198; 348/128
(58) Field of Search ..... 37/197, 198; 348/144, 348/147, 146, 98, 106, 135, 128, 125; 701/223

(56) References Cited

U.S. PATENT DOCUMENTS 4,700,564 A * 10/1987 Prasil et al. ..... 73/146
5,481,479 A * 1/1996 Wight et al. ..... 701/223
6,356,299 B1 * 3/2002 Trosino et al. ..... 348/128

FOREIGN PATENT DOCUMENTS

| | | |
|---|---|---|
| DE | 4222 333 | 1/1993 |
| DE | 41 02 871 | 8/1999 |
| EP | 0 806 523 | 5/1996 |
| EP | 0722 013 | 7/1996 |
| EP | 1 028 325 | 1/2000 |
| GB | 2240 570 | 8/1991 |

* cited by examiner

*Primary Examiner*—Robert E. Pezzuto
(74) *Attorney, Agent, or Firm*—Collard & Roe, P.C.

(57) ABSTRACT

A track maintenance machine comprises a machine frame, a track scanning unit adjustable connected to the machine frame and having flanged rollers for moving the track scanning unit along the track, a satellite receiver connected to the machine frame, the satellite receiver having an antenna with an antenna center, a measuring device for monitoring the position of the antenna center relative to the track scanning unit with respect to the following parameters: transverse track tilting (β), transverse track displacement (d) perpendicular to a longitudinal extension of the machine frame, and vertical distance (a), and a computer for a computed repositioning of the antenna center relative to a reference point of the track scanning unit.

8 Claims, 2 Drawing Sheets

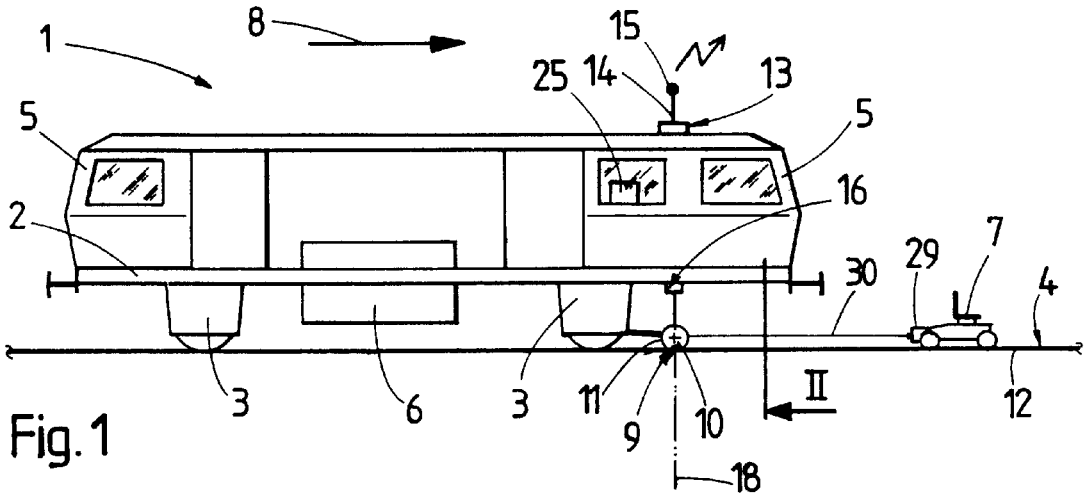
Fig. 1
Fig. 2
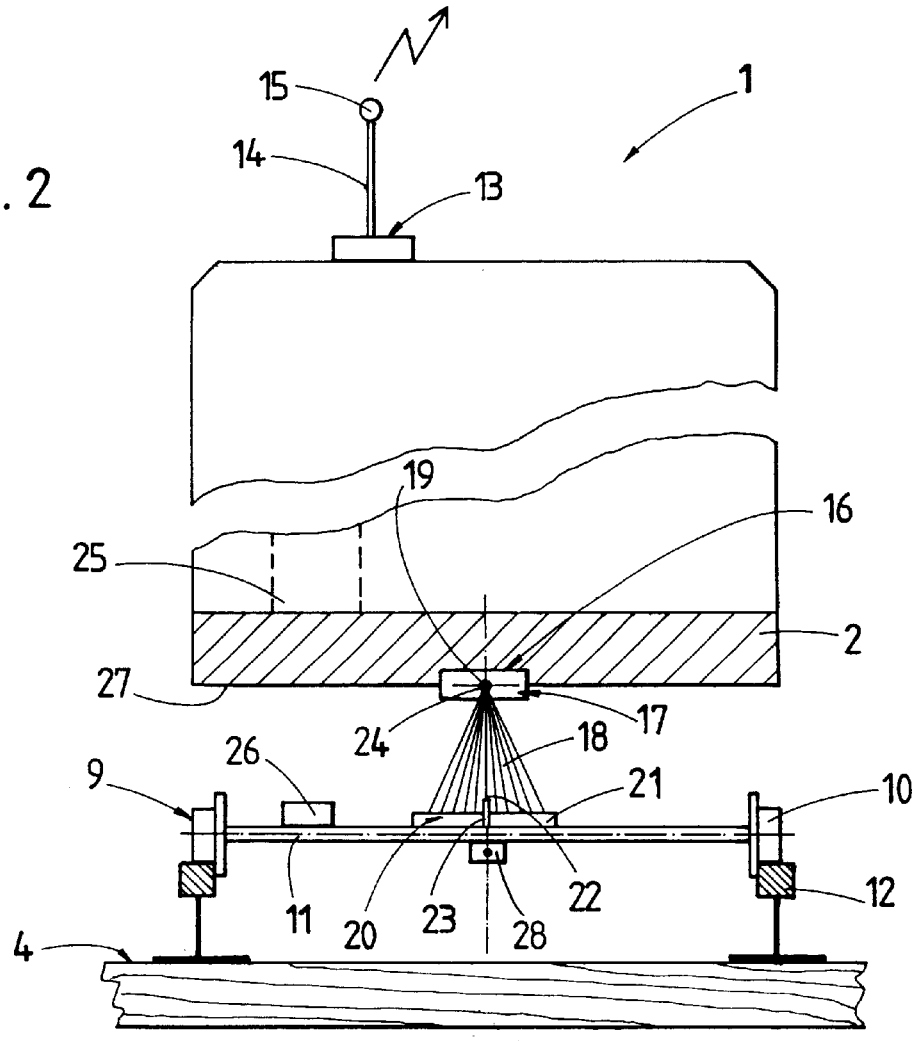

TRACK MAINTENANCE MACHINE AND METHOD FOR MONITORING A TRACK POSITION

BACKGROUND OF THE INVENTION

1. Field of the Invention

The present invention relates to a track maintenance machine comprising a machine frame having undercarriages for moving the machine frame in an operating direction along a track, and a track scanning unit adjustably connected to the machine frame and having flanged rollers for moving the track scanning unit along the track. This invention also relates to a method of monitoring a track position.

2. Description of the Prior Art

A machine and method of this type is known, for example, from EP 0 806 523 A1. The position of a track lifting device, which senses the track position, is measured relative to a machine frame of the track maintenance machine, and the machine frame position is determined by means of geodetically measured fixed points defining the absolute track position.

Furthermore, it is known from DE 41 02 871 C2 to measure the displacement of a track scanning unit, such as a measuring axle rolling on a track, relative to a machine frame of a track tamping machine running on the track.

Finally, EP 1 028 325 A2 discloses a method of measuring a track position by means of two independently moving measuring carriages positioned on the track at the end points of a track section to be measured.

SUMMARY OF THE INVENTION

It is the object of the invention to provide a machine and method of this general type, which enables the position of a track to be monitored quickly and with dependable accuracy.

According to one aspect of the present invention, this object is accomplished with a track maintenance machine of the first-described type, which comprises a satellite receiver connected to the machine frame, the satellite receiver having an antenna with an antenna center, a measuring device for monitoring the position of the antenna center relative to the track scanning unit with respect to the following parameters: transverse superelevation (β), transverse displacement (d) perpendicular to a longitudinal extension of the machine frame and vertical distance (a), and a computer for a computed repositioning of the antenna center relative to a reference point of the track scanning unit.

Such a machine makes it possible to obtain an exact parallel guidance of the antenna center relative to the center axis of the track, despite a front arrangement of the satellite receiver on the machine frame, which assures an optimal reception of the extraterrestrial position signals by the satellite receiver.

According to another aspect of this invention, a method of monitoring a track position by scanning the track comprises the steps of determining the position of an antenna center of an antenna of a satellite receiver receiving extraterrestrial position signals relative to a reference point on a track scanning unit adjustably connected to a machine frame of a track maintenance machine and having flanged rollers for moving the machine frame in an operating direction along the track, the satellite receiver also being connected to the machine frame, and automatically recording the absolute track position coordinates in the range of the track scanning unit by determining the coordinate position of the antenna center by means of the position signals.

BRIEF DESCRIPTION OF THE DRAWING

The above and other objects, advantages and features of the invention will become more apparent from the following detailed description of now preferred embodiments thereof, taken in conjunction with the drawing wherein FIG. 1 shows a side elevational of a track maintenance machine according to the present invention;

FIG. 2 is an enlarged, schematic cross sectional view along line II—II of FIG. 1.

DETAILED DESCRIPTION OF THE PREFERRED EMBODIMENTS

Figure 3:
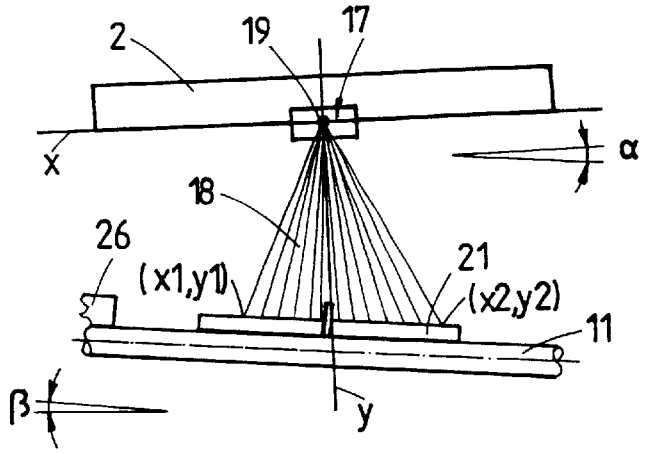
FIGS. 3, 4 and 5 diagrammatically illustrate different steps of the method of this invention.

FIGS. 1 and 2 illustrate a track maintenance machine 1 comprising machine frame 2 having undercarriages 3 for moving the machine frame in an operating direction indicated by arrow 8 along track 4. Driver's and operator's cabs 5 as well as power unit 6 are provided on machine frame 2. As disclosed in EP 1 028 325 A2 and, therefore, not further described, satellite carriage 7 carrying laser transmitter 29 is movable on track 4 independently of machine 1 for measuring the existing position of the track in front of the machine, in the operating direction.

Track scanning unit 9 is adjustably connected to machine frame 2 and has flanged rollers 10 for moving the track scanning unit along the track. In the illustrated embodiment, the track scanning unit comprises measuring axle 11 connected to laser receiver 28 for generating measuring line 30 in conjunction with laser transmitter 29. Measuring axle 11 is pivotally linked to machine frame 2 forwardly of front undercarriage 3, with respect to the operating direction indicated by arrow 8. Drives (not shown to avoid crowding of the drawing) vertically adjustably connect measuring axle 11 to machine frame 2 to enable the measuring axle to be lowered onto the track for engagement of flanged rollers 10 with track rails 12 at the beginning of the measuring operations.

Satellite receiver 13 is fixedly connected to machine frame 2, the satellite receiver having antenna 14 with antenna center 15 for receiving extraterrestrial position signals (GPS-signals) emitted from space satellites. As shown in FIG. 1, antenna 14 of satellite receiver 13 is connected to machine frame 2 directly above track scanning unit 9.

Figure 4:
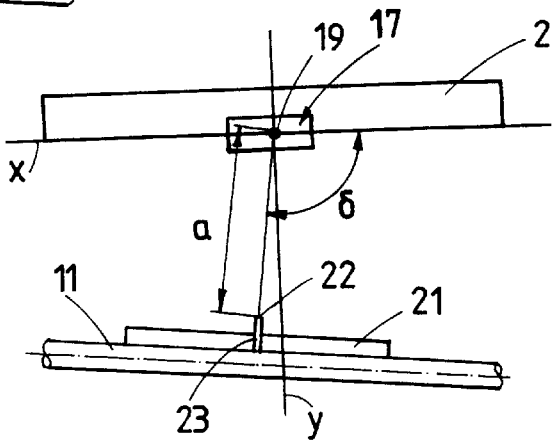
Figure 5:
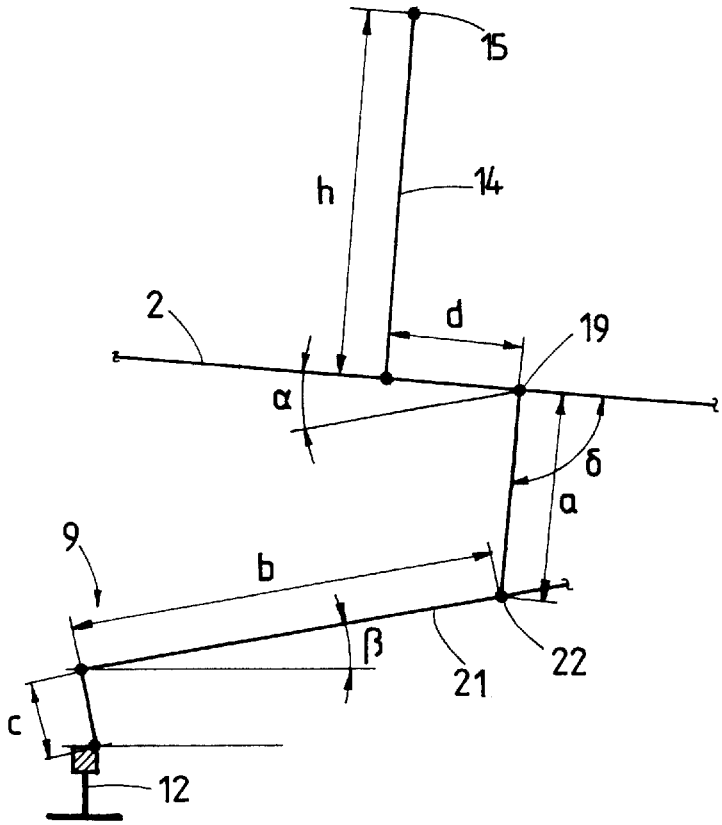

Measuring device 16 monitors the position of antenna center 15 relative to track scanning unit 9 with respect to the following parameters indicated in FIGS. 3–5: track superelevation (β), transverse track displacement (d) perpendicular to a longitudinal extension of the machine frame, and vertical distance (a). The illustrated measuring device is a laser scanner 17 connected to the machine frame, the laser scanner generating a scanning plane 18 extending transversely to the longitudinal extension of the machine frame from a point of origin 19. Point of origin 19 forms optical center 24 of measuring device 16 relative to the longitudinal extension of the machine frame and is arranged on underside 27 of machine frame 2 aligned with, and above, track scanning unit 9. Scanning target 20 is centered on track scanning unit 9 between flanged rollers 10 for being scanned by laser scanner 17, and reference point 22 is also centered between the flanged rollers. The illustrated scanning target is a ruler 21 extending transversely to the longitudinal extension of machine frame 2 and the reference point is a peg 23 projecting from the ruler. Computer 25 serves for a computed repositioning of antenna center 15 relative to reference point 22 of track scanning unit 9.

The method of monitoring a track position by scanning track 4 will be explained in connection with FIGS. 3, 4 and 5. This method comprises the steps of determining the position antenna center 15 of antenna 14 of satellite receiver 13 receiving extraterrestrial position signals relative to reference point 22 on track scanning unit 9 adjustably connected to machine frame 2 of track maintenance machine 1 and having flanged rollers 10 for moving machine frame 2 in operating direction 8 along track 4. Satellite receiver 13 also is connected to machine frame 2. The absolute track position coordinates are automatically recorded in the range of track scanning unit 9 by determining the coordinate position of antenna center 15 by means of the position signals.

The position of antenna center 15 relative to track scanning unit 9 is determined with respect to the following parameters: track superelevation (β), transverse displacement (d) perpendicularly to the longitudinal extension of machine frame 2, and vertical distance (a). When the track position is determined by scanning track 4, and taking these parameters into account, computer 25 on machine 1 will automatically produce a repositioning of antenna center 15 relative to reference point 22 of track scanning unit 9. In other words, the position of antenna center 15 of satellite receiver 13 mounted on machine frame 2 relative to reference point 22 of track scanning unit 9 linked to the machine frame and running on track 4 is determined, whereby the absolute track position coordinates in the range of track scanning unit 9 are automatically recorded by means of the position of the coordinates of antenna center 15 obtained by the extraterrestrial position signals (GPS-signals).

FIG. 3 schematically illustrates the measurement of the transverse inclination of machine frame 2 relative to measuring axle 11 of track scanning unit 9. Normally, because of shock absorbers on undercarriages 3 supporting machine frame 2 on track 4, the machine frame will have a transverse inclination differing from that of measuring axle 11, whose inclination corresponds to superelevation (β) of track 4. This difference in the transverse inclinations of machine frame 2 and measuring axle 11 is ascertained by laser scanner 17 establishing an xy coordinate system whose zero-point is in point of origin 19 of scanning plane 18 generated by the laser scanner. Coordinates x1, y1 and x2, y2 of the outermost laser beams impinging upon transversely extending ruler 21 are calculated in the coordinate system in computer 25, and the computer accordingly calculates the inclination (α) of machine frame 2. Since angle (α) only indicates the angle between machine frame 2 and measuring axle 11, it is necessary to determine the absolute inclination of the machine frame relative to the horizontal. For this purpose, the transverse inclination of measuring axle 11, which corresponds to track superelevation (β), is measured by inclinometer 26 mounted on the measuring axle. The value of angle (α) is subtracted from that of angle (β) to obtain the absolute inclination of machine frame 2.

FIG. 4 schematically illustrates the calculation of vertical distance (a) between measuring axle 11 and machine frame 2. Laser scanner 17 delivers for every step a measurement of the angle as well as of the vertical distance from scanned ruler 21. Thus, projecting peg 23 centered on ruler 21 and forming reference point 22 is clearly identified by laser scanner 17, and its horizontal and vertical position relative to point of origin 19 is clearly determined. Therefore, it is possible to ascertain the vertical and horizontal distance between measuring axle 11 and machine frame 2. To find reference point 22 (peg 23), that scanning beam which shows a minimal distance in the center is selected from the distance measurements of laser scanner 17. This scanning beam characterizes vertical distance (a) and the angle (δ) in coordinate system xy, wherein machine frame 2 forms the x-axis and the zero-point lies in point of origin 19 of laser scanner 17. In this way, reference point 22 is fixed in this coordinate system by means of values (a) and (δ).

Since the coordinate system first deviates from the horizontal by the inclination of the machine frame, the computer must turn the entire coordinate system to the horizontal by the value of the angle of the machine frame inclination to make it possible to calculate the vertical and horizontal distance from the zero point.

FIG. 5 schematically illustrates the use of the essential parameters in the method of this invention. Before the scanning operation of track maintenance machine 1 begins, the following constants are ascertained:

h=vertical distance of antenna center 15 of satellite receiver 13 from point of origin 19 of laser scanner 17.

d=horizontal distance of antenna 14 and its center 15 from point of origin 19 of laser scanner 17.

b=distance of the inner edge of track rail 12 from reference point 22 on ruler 21.

c=vertical distance of ruler 21 and its reference point 22 from the upper edge of track rail 12.

The measurements described hereinabove in connection with FIGS. 3 and 4 produce the following values:

α=relative transverse inclination of machine frame 2.

β=superelevation of track 4, which corresponds to the transverse inclination of measuring axle 11.

δ=angle at which laser scanner 17 identifies peg 23 (reference point 22).

a=distance between point of origin 19 of laser scanner 17 and reference point 22 on ruler 21, as measured by the laser scanner.

The vertical and horizontal distances between the GPS-antenna 14 and the contact point of track scanning unit 9 with rails 12 is computed on the basis of these data.

What is claimed is:

1. A track maintenance machine comprising (a) a machine frame having undercarriages for moving the machine frame in an operating direction along a track, (b) a track scanning unit adjustably connected to the machine frame and having flanged rollers for moving the track scanning unit along the track, (c) a satellite receiver connected to the machine frame, the satellite receiver having (i) an antenna with an antenna center, (d) a measuring device for monitoring the position of the antenna center relative to the track scanning unit with respect to the following parameters: superelevation (β), transverse displacement (d) perpendicular to a longitudinal extension of the machine frame and vertical distance (a), and (e) a computer for a computed repositioning of the antenna center relative to a reference point of the track scanning unit.

2. The track maintenance machine of claim 1, wherein the measuring device is a laser scanner connected to the machine frame, the laser scanner generating a scanning plane extending from a point of origin transversely to the longitudinal extension of the machine frame.

3. The track maintenance machine of claim 2, wherein a scanning target is centered on the track scanning unit between the flanged rollers for being scanned by the laser scanner, and the reference point is also centered between the flanged rollers.

4. The track maintenance machine of claim 3, wherein the scanning target is a ruler and the reference point is a peg projecting from the ruler.

5. The track maintenance machine of claim 1, wherein an optical center of the measuring device relative to the longitudinal extension of the machine frame is arranged on an underside of the machine frame above the track scanning unit.

6. The track maintenance machine of claim 1, wherein the track scanning unit comprises a measuring axle connected to a laser receiver for generating a measuring line, and the measuring axle is pivotally linked to the machine frame forwardly of a front undercarriage with respect to the operating direction.

7. The track maintenance machine of claim 1, wherein the antenna of the satellite receiver is connected to the machine frame above the track scanning unit.

8. A method of monitoring a track position by scanning the track, which comprises the steps of (a) determining the position an antenna center of an antenna of a satellite receiver receiving extraterrestrial position signals relative to a reference point on a track scanning unit adjustably connected to a machine frame of a track maintenance machine and having flanged rollers for moving the machine frame in an operating direction along the track, the satellite receiver also being connected to the machine frame, and (b) automatically recording the absolute track position coordinates in the range of the track scanning unit by determining the coordinate position of the antenna center by means of the position signals.

* * * * *